US006078485A

United States Patent [19]

Perdoncin

[11] Patent Number: 6,078,485

[45] Date of Patent: Jun. 20, 2000

[54] MEDIUM- AND HIGH-VOLTAGE GAS-INSULATED CIRCUIT BREAKER WITH ARC QUENCHING MEANS

[75] Inventor: Francesco Perdoncin, Villa Di Serio, Italy

[73] Assignee: Abb Sace T.M.S. S.p.A., Dalmine, Italy

[21] Appl. No.: 09/174,334

[22] Filed: Oct. 19, 1998

[30] Foreign Application Priority Data

Oct. 21, 1997 [IT] Italy ..... MI97A2372

[51] Int. Cl.[7] ..... H01H 33/72

[52] U.S. Cl. ..... 361/14; 361/134; 218/59

[58] Field of Search ..... 218/13, 15, 26, 218/29, 34, 51–53, 57, 59, 63, 116, 117; 361/2, 14, 115, 116, 123, 5, 133–135

[56] References Cited

U.S. PATENT DOCUMENTS 3,728,507 4/1973 Floessel et al. ..... 218/82
4,221,942 9/1980 Hertz et al. ..... 218/48

*Primary Examiner*—Ronald W. Leja
*Attorney, Agent, or Firm*—Guido Modiano; Albert Josif; Daniel O'Byrne

[57] ABSTRACT

A medium- and high-voltage gas-insulated circuit breaker with arc quenching capability, comprising an electrical contact which is provided with a fixed element and with a movable element which can be mutually coupled and which form, upon separation, an arc channel into which a blast of gas is introduced which is generated by a gas chamber provided with an orifice which is controlled by a valve. The particularity of the invention is constituted by the fact that the valve is driven by the current that flows across the electrical contact.

6 Claims, 3 Drawing Sheets

MEDIUM- AND HIGH-VOLTAGE GAS-INSULATED CIRCUIT BREAKER WITH ARC QUENCHING MEANS

BACKGROUND OF THE INVENTION

The present invention relates to a medium- and high-voltage gas-insulated circuit breaker with arc quenching means.

Medium- and high-voltage gas-insulated circuit breakers, such as for example circuit breakers using sulfur hexafluoride ($SF_6$), air or nitrogen, are conventionally equipped with systems which produce a pressure differential between two separate volumes so as to produce a blast of gas onto the arc region and thus quench the arc.

Thermodynamic systems, which in practice utilize the heat generated by the arc, or mechanical systems, in which a volume of gas is compressed so as to make it flow into the region where the arc is present, are used to generate the pressure differential.

Mechanical generation is normally used whenever the current is unable to generate the intended pressure value thermodynamically.

With mechanical systems for generating the pressure difference, relatively large arcs can be generated in the presence of high currents. Such arcs accordingly obstruct the ducts for exhausting the pressurized gas that should quench the arc, accordingly preventing the discharge of the gas from the gas volume that is compressed. The considerable overpressures that are consequently generated are such as to block the movement of the movable element, thus creating the preconditions for failure to quench the electric arc and jamming of the actuation of the circuit breaker.

Mechanical valves which open when the pressure differentials reach preset levels, so as to reduce the energy required for the actuation system that moves the contacts, have already been used to solve this problem.

However, mechanical valves do not always have a repeatable behavior and are very difficult to calibrate, preventing an assured determination of the pressure differential value that causes the activation thereof.

SUMMARY OF THE INVENTION

The aim of the present invention is to eliminate the above-mentioned drawbacks, by providing a medium- and high-voltage gas-insulated circuit breaker with arc quenching means in which it is possible to actuate the exhaust valve according to the size of the arc that is generated, thus eliminating the occurrence of high pressures in the gas compression chamber and thus solving the problem of possible failure of the circuit breaker to intervene.

Within the scope of this aim, a particular object of the present invention is to provide a medium- and high-voltage gas-insulated circuit breaker in which optimum repeatability and calibration of the intervention thresholds of the exhaust valve is achieved.

Another object of the present invention is to provide a gas-insulated circuit breaker which, by means of its particular constructive characteristics, is capable of giving the greatest assurances of reliability and safety in use.

Another object of the present invention is to provide a medium- and high-voltage gas-insulated circuit breaker which can be easily obtained starting from commonly commercially available elements and materials and is also competitive from a purely economical point of view.

This aim, these objects and others which will become apparent hereinafter are achieved by a medium- and high-voltage gas-insulated circuit breaker with arc quenching means, comprising an electrical contact which is provided with a fixed element and with a movable element which can be mutually coupled and which form, upon separation, an arc channel into which a blast of gas is introduced which is generated by a gas chamber provided with an orifice which is controlled by valve means, characterized in that said valve means are driven by the current that flows across said electrical contact.

BRIEF DESCRIPTION OF THE DRAWINGS

Further characteristics and advantages of the present invention will become apparent from the following detailed description of a preferred but not exclusive embodiment of a medium- and high-voltage gas-insulated circuit breaker with arc quenching means, illustrated only by way of non-limitative example in the accompanying drawings, wherein.

DESCRIPTION OF THE PREFERRED EMBODIMENTS

Figure 2:
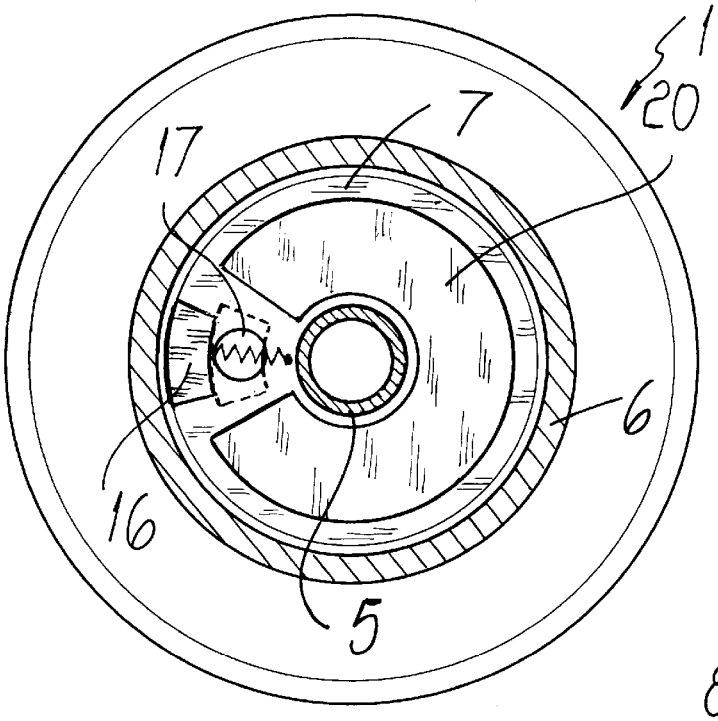
FIG. 2 is a plan view of the plunger of the circuit breaker according to the invention with the valve means in a partially open position.

With reference to the above figures, the medium- and high-voltage gas-insulated circuit breaker with arc quenching means according to the invention, generally designated by the reference numeral 1, comprises an electrical contact which is constituted by a fixed element 2 accommodated in a movable element 3 that forms an arc channel 4 upon separation.

The movable contact 3 has a central movable contact bar 5 and an outer cylindrical body 6 which delimits, together with a fixed plunger 7, a gas chamber 8 connected to the arc channel 4 by means of ducts 10 that produce a blast of gas in the arcing region.

Valve means, generally designated by the reference numeral 15, are also provided on the fixed plunger 7 and are obtained by means of a gate 16 which is actuated electromagnetically directly by the current that flows across the electrical contact.

In practice, an electromagnetic valve is provided which is constituted by the gate 16, made of ferromagnetic material, which controls an orifice 17. Under the effect of the magnetic field generated by the current that flows across the conductors, the gate 16 is actuated so as to open or close the orifice 17, thus adjusting the discharge of the gas and in particular allowing outward discharge of the gas that is present in the chamber 8 when the presence of a large arc produces thermal effects which might prevent the flow of the gas from the gas chamber, to the point of jamming the movement of the circuit breaker.

The opening of the valve 15 is directly correlated to the intensity of the current and is accordingly directly correlated to the type of arc that is generated.

Advantageously, it is possible to provide a fixed magnetic element, designated by the reference numeral 20, which is meant to increase the concentration of the lines of the magnetic field at the gate 16 and in practice forms the movable keeper.

Figure 3:
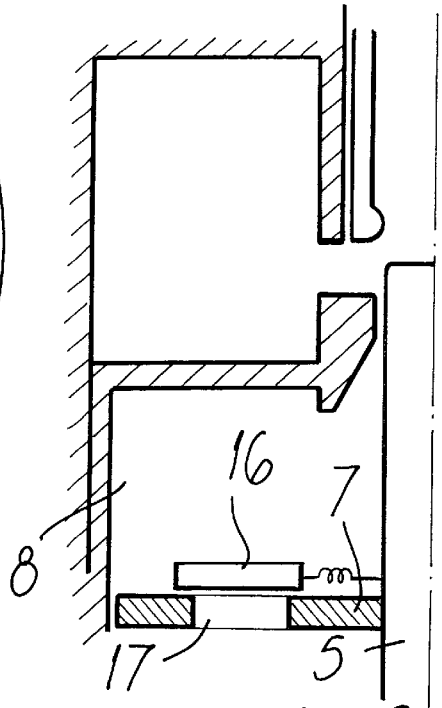
FIG. 3 is a schematic view of the contact with suction-generated blast.
Figure 1:
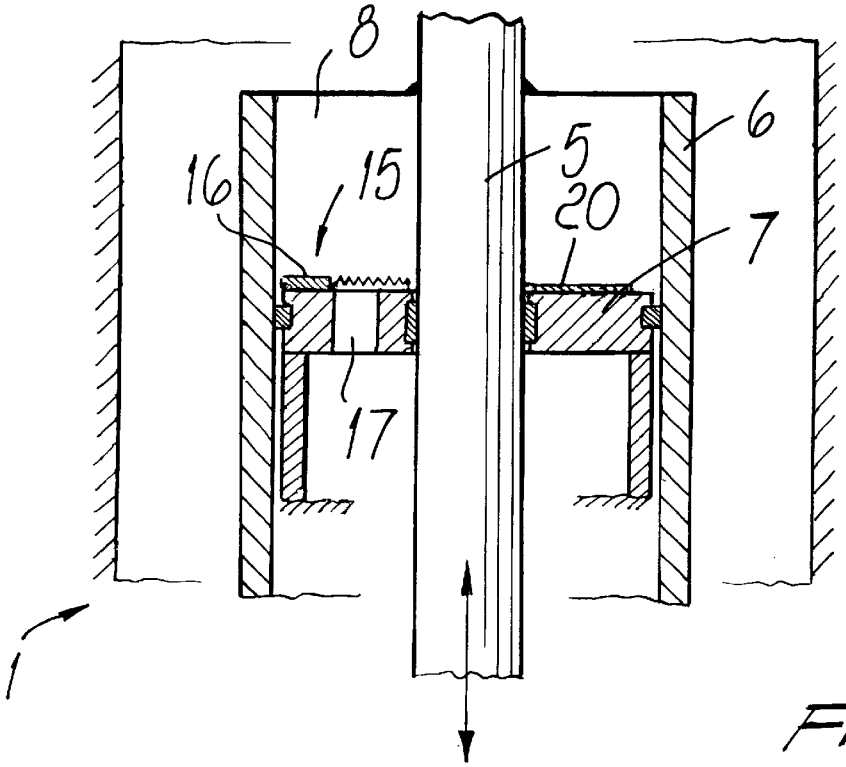
FIG. 1 is a schematic view of the plunger for delimiting the gas chamber with the valve means of the circuit breaker according to the present invention.
Figure 4:
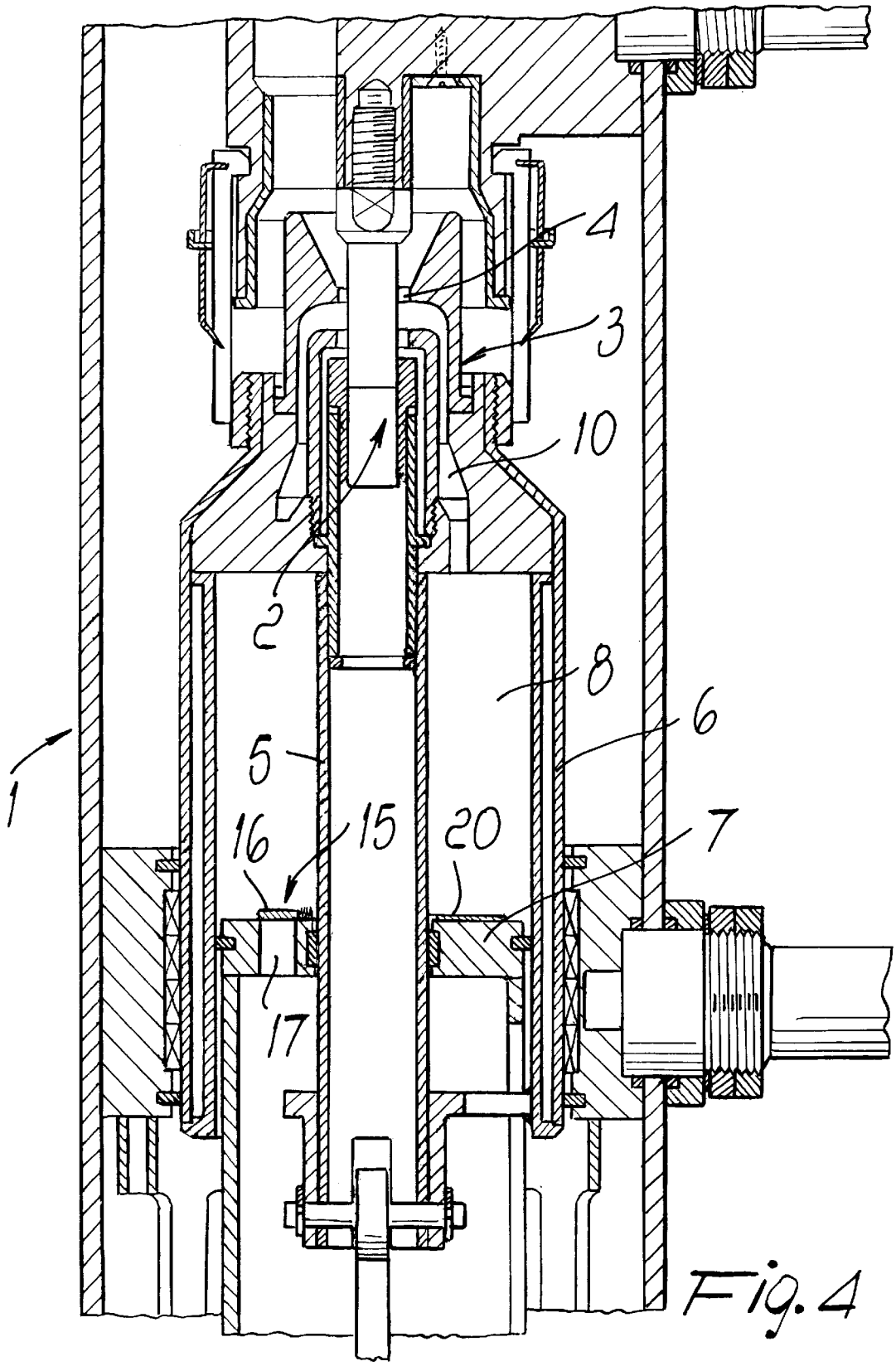
FIG. 4 is a partially sectional view of the gas-insulated circuit breaker of the invention with the electrical contact in closed position.
Figure 5:
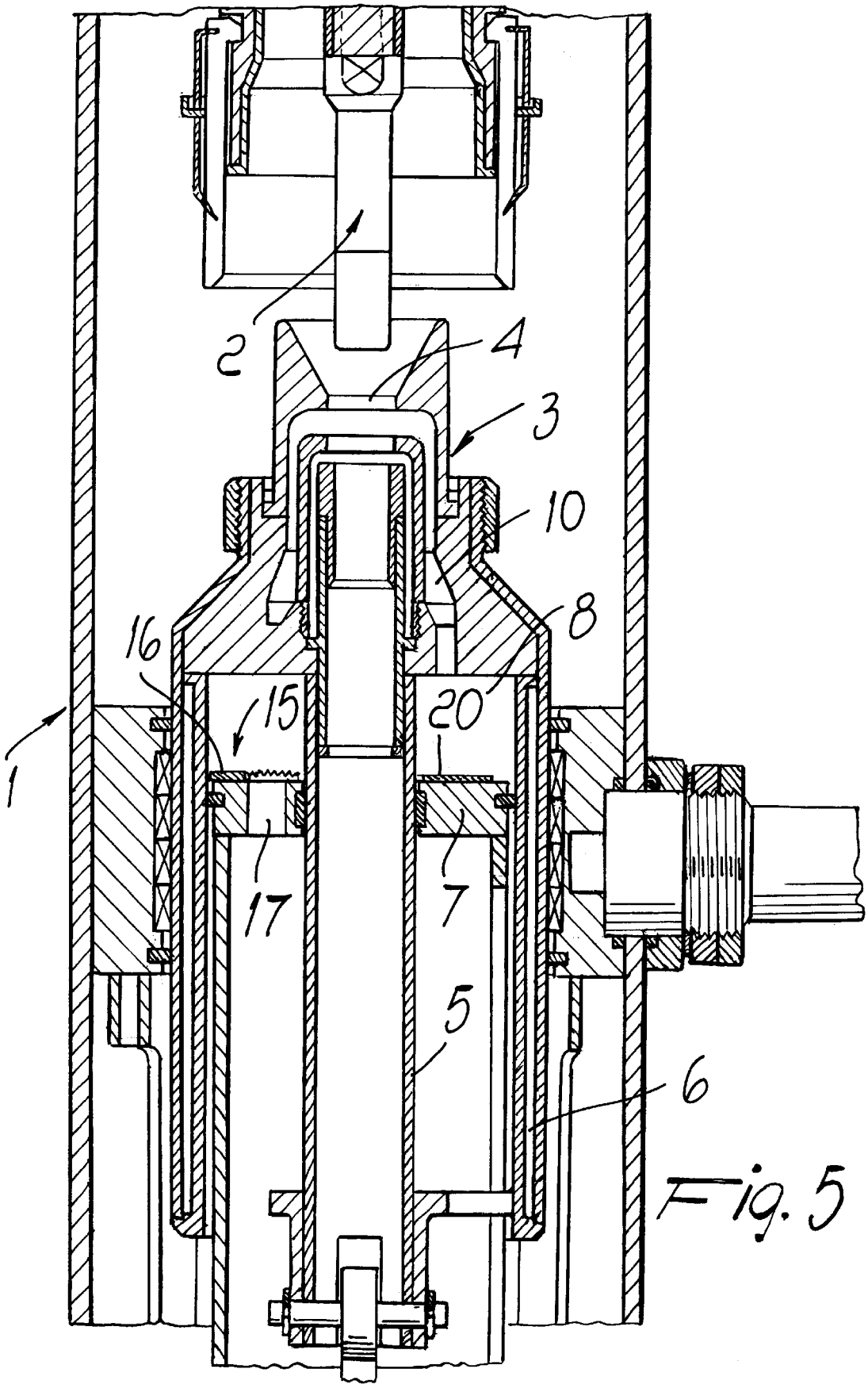
FIG. 5 is a view of the gas-insulated circuit breaker of the invention during the opening of the electrical contact.

This kind of electromagnetically controlled valve can be applied both when the gas blast is generated by compression of the gas chamber and when the stream is instead generated by suction in the gas chamber, as shown in FIG. 3.

From the above description it is evident that the invention achieves the intended aim and objects, and in particular the fact is stressed that a valve is provided which, being driven directly by the current, is not affected by variations or defects in calibration and can also allow gradual opening of the exhaust orifice, thus compensating for blockage of the exhaust channels and ensuring a compression level in the volume which causes no slowing or, worse still, stoppage of the movement of the movable element of the circuit breaker.

From the above description it is thus evident that the invention achieves the intended aim and objects, and in particular the fact is stressed that the adoption of valve means of the electromagnetic type allows to significantly increase the reliability of said valve means, assuredly preventing activation failures.

The invention thus conceived is susceptible of numerous modifications and variations, all of which are within the scope of the inventive concept; all the details may also be replaced with other technically equivalent elements.

In practice, the materials employed, as well as the contingent shapes and the dimensions, may be any according to requirements.

What is claimed is:

1. A medium- and high-voltage gas-insulated circuit breaker with arc quenching means, comprising electrical contacts which comprise a fixed element and a movable element adapted to be mutually coupled and which form, upon separation, an arc channel into which a blast of gas is introduced which is generated by a gas chamber provided with an orifice, said orifice being controlled by valve means adapted to continuously adjust the gas pressure inside said gas chamber when the arc is generated, wherein said valve means are driven by the current that flows across said electrical contacts, the degree of opening of the valve means being directly proportional to said current.

2. The gas-insulated circuit breaker according to claim 1, wherein said valve means are of the electromagnetic type.

3. The gas-insulated circuit breaker according to claim 1, wherein said valve means comprise a gate made of ferromagnetic material which controls said orifice, said gate being adapted to constitute a movable keeper of an electromagnetically actuated element.

4. The gas-insulated circuit breaker according to claim 3, comprising a fixed magnetic element to increase concentration of lines of a magnetic field at said gate.

5. The gas-insulated circuit breaker according to claim 1, wherein said gas chamber is delimited, around the movable element of said electrical contacts, by an external cylinder which is rigidly coupled to said movable element and by a fixed plunger.

6. The gas-insulated circuit breaker according to claim 5, wherein said orifice is formed in said fixed plunger.

* * * * *